US007027748B2

(12) United States Patent
Funatani

(10) Patent No.: US 7,027,748 B2
(45) Date of Patent: Apr. 11, 2006

(54) IMAGE FORMING APPARATUS AND DENSITY DETECTION PATTERN FORMING METHOD THEREIN

(75) Inventor: Kazuhiro Funatani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 10/778,096

(22) Filed: Feb. 17, 2004

(65) Prior Publication Data

US 2004/0165898 A1 Aug. 26, 2004

(30) Foreign Application Priority Data

Feb. 20, 2003 (JP) ..... 2003-042592

(51) Int. Cl.
*G03G 15/00* (2006.01)

(52) U.S. Cl. ..... 399/49; 399/72

(58) Field of Classification Search ..... 399/38, 399/39, 46, 49, 72, 40; 347/115, 116
See application file for complete search history.

(56) References Cited

U.S. PATENT DOCUMENTS

| | | | | |
|---|---|---|---|---|
| 6,298,586 | B1 * | 10/2001 | Todome | 399/303 |
| 6,408,156 | B1 * | 6/2002 | Miyazaki et al. | 399/301 |
| 6,512,898 | B1 | 1/2003 | Funatani | 399/49 |
| 6,911,993 | B1 * | 6/2005 | Nishikawa et al. | 347/116 |
| 2001/0010533 | A1 * | 8/2001 | Kanno | 347/116 |
| 2002/0186980 | A1 | 12/2002 | Tsuruya et al. | 399/49 |
| 2003/0044190 | A1 * | 3/2003 | Nakayama | 399/49 |
| 2005/0185856 | A1 * | 8/2005 | Nakajima | 382/274 |

* cited by examiner

*Primary Examiner*—Hoan Tran
(74) *Attorney, Agent, or Firm*—Fitzpatrick, Cella, Harper & Scinto

(57) ABSTRACT

In an image forming apparatus which forms an image on an image carrier, a predetermined density pattern is segmented into a plurality of blocks to generate the plurality of blocks. The density patterns of the plurality of generated blocks are controlled to be formed on the image carrier so as not to superpose the density patterns in two successive turns of the image carrier.

8 Claims, 13 Drawing Sheets

FIG. 11

| TURN OF PHOTOSENSITIVE DRUM | A | B | C | D | E | F | G | H | I |
|---|---|---|---|---|---|---|---|---|---|
| FIRST TURN | 1 | | | | 2 | | | | 3 |
| SECOND TURN | | | | 4 | | | | 5 | |
| THIRD TURN | | | 6 | | | | 7 | | |
| FOURTH TURN | | 8 | | | | 9 | | | |
| FIFTH TURN | 10 | | | | 11 | | | | 12 |
| SIXTH TURN | | | | 13 | | | | 14 | |
| SEVENTH TURN | | | 15 | | | | 16 | | |

IMAGE FORMING APPARATUS AND DENSITY DETECTION PATTERN FORMING METHOD THEREIN

FIELD OF THE INVENTION

The present invention relates to an image forming apparatus using an electrophotographic process and a density pattern forming method in the image forming apparatus.

BACKGROUND OF THE INVENTION

Image forming methods in image forming apparatuses such as a printer apparatus are roughly classified into an electrophotographic method, thermal transfer method, and ink-jet method. Image forming apparatuses using the electrophotographic method are higher in speed, image quality, and quietness than those using other methods, and have recently become popular. Electrophotographic methods are further categorized into various methods. For example, in addition to a well-known multi-transfer method and intermediate transfer member method, there is proposed a multiple development method of overlapping Y, M, C, and K color images on the surface of a photosensitive body to form a full-color image, transferring the full-color image onto a print sheet at once, and thereby forming the image. There is also proposed an in-line method in which image forming means (process stations) for different colors are aligned and images developed by the process stations are sequentially transferred onto a transfer medium (print sheet) conveyed by a transfer belt. The in-line method can increase the speed, and exhibits high print image quality.

When an image is formed by the in-line method, the density of a printed image varies depending on temperature and humidity conditions under which the printer apparatus is used, and the use frequency of the process stations. To correct variations, the image density is controlled. Image density control will be explained.

Image density control has conventionally adopted a means for forming a density patch image of each color on a photosensitive body, intermediate transfer member, or electrostatic transfer belt (ETB), reading the density patch image by a density sensor, feeding back the result to process forming conditions such as a high-voltage condition and laser power, and adjusting the maximum density and halftone characteristic of each color.

In general, the density sensor irradiates a density patch by a light from a light source, and detects the reflected-light intensity by a light-receiving sensor. The reflected-light intensity signal is A/D-converted, processed by a CPU, and fed back to process forming conditions. The purposes of image density control are to keep the maximum density of each color constant (to be referred to as Dmax control hereinafter) and to keep the halftone characteristic linear to an image signal (to be referred to as Dhalf control hereinafter). Dmax control keeps the color balance between colors constant, and at the same time prevents any scattering and fixing errors of a color-overlapped character caused by an excessive amount of toner.

More specifically, in Dmax control, densities of a plurality of density patches formed by changing image forming conditions are detected by an optical sensor. Conditions under which a desired maximum density is obtained are calculated from the detected results, and the image forming conditions are changed. Each density patch is preferably formed not at a maximum density but at an intermediate density. This is because, if the density of each density patch is close to the maximum density in detecting a so-called solid image for forming a density patch, the change width of an output of the sensor upon a change in toner amount becomes narrow, failing to obtain a satisfactory detection precision.

In Dhalf control, image processing of canceling the γ characteristic and keeping the input/output characteristic linear is performed to prevent any failure in forming a natural image due to a shift of the outputted density to an input image signal caused by a nonlinear input/output characteristic (γ characteristic) unique to electrophotography. More specifically, a plurality of density patches corresponding to different input image signals are detected by an optical sensor, and an input image signal from a host computer is so converted as to obtain a desired density on the basis of the relationship between each input image signal and the density of a corresponding density patch. Dhalf control is generally performed after image forming conditions have been determined by Dmax control.

The density patch formed on the above-mentioned ETB is electrostatically recovered by a process device in a cleaning process. In the cleaning process, a bias having a polarity opposite to the charging polarity of toner is applied to a photosensitive body. Toner is attracted to the photosensitive body in a transfer section, and scraped by a cleaning blade similarly to residual transfer toner.

To perform density control at higher precision, the number of density patches is desirably increased as much as possible. When the number of density patches is increased, however, to form density patches over one or more turns of a photosensitive drum, a problem occurs.

When density patches are formed even in the second and subsequent turns of the photosensitive drum, as shown in FIG. 13, density patch portions formed in the second and subsequent turns of the photosensitive drum are influenced (memory effect) by density patches formed in the first turn of the photosensitive drum. No accurate density is output, resulting in a density control error. To prevent this, the density patch range is generally set within one turn of the photosensitive drum even if the number of density patches is increased. As a measure, each density patch may be downsized to form patches as many as possible within one turn of the photosensitive drum. This measure is, however, undesirable because of the following reasons.

1. Influence of Sweeping Phenomenon

The sweeping phenomenon is that a larger amount of toner is used for development at the trailing end of an electrostatic latent image in comparison with the remaining portion, increasing the density. When the density patch is downsized, the area of the sweeping portion to the density patch increases, and a density higher than an actual one is detected at high possibility.

2. Density Sensor Attachment Position Error

When the density patch is downsized and a position deviated from the center of the density patch is detected due to a density sensor attachment position error, the region suffering the sweeping phenomenon is detected at high possibility.

SUMMARY OF THE INVENTION

The present invention has been made in consideration of the above situation, and has as its feature to accurately detect the density without any influence of a density pattern previously formed on an image carrier even when the size of the density pattern is increased to increase the density control precision.

According to the present invention, there is provided with an image forming apparatus for forming an image on an image carrier, comprises: detection pattern generation means for segmenting a predetermined density pattern into a plurality of blocks and generating the plurality of blocks; and control means for controlling to form, on the image carrier, density patterns of the plurality of blocks generated by the detection pattern generation means so as not to superpose the density patterns in two successive turns of the image carrier.

Further, according to the present invention, there is provided with a density pattern forming method in an image forming apparatus which forms an image on an image carrier, comprises: a detection pattern generation step of segmenting a predetermined density pattern into a plurality of blocks and generating the plurality of blocks; and a control step of controlling to form, on the image carrier, density patterns of the plurality of blocks generated in the detection pattern generation step so as not to superpose the density patterns in two successive turns of the image carrier.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIG. 11 depicts a table for explaining formation of a density patch according to the second embodiment of the present invention;

DETAILED DESCRIPTION OF THE PREFERRED EMBODIMENTS

Preferred embodiments of the present invention will be described in detail below with reference to the accompanying drawings, but the present invention is not limited to them. Only the features of the present invention will be mainly explained.

[First Embodiment]

Figure 1:
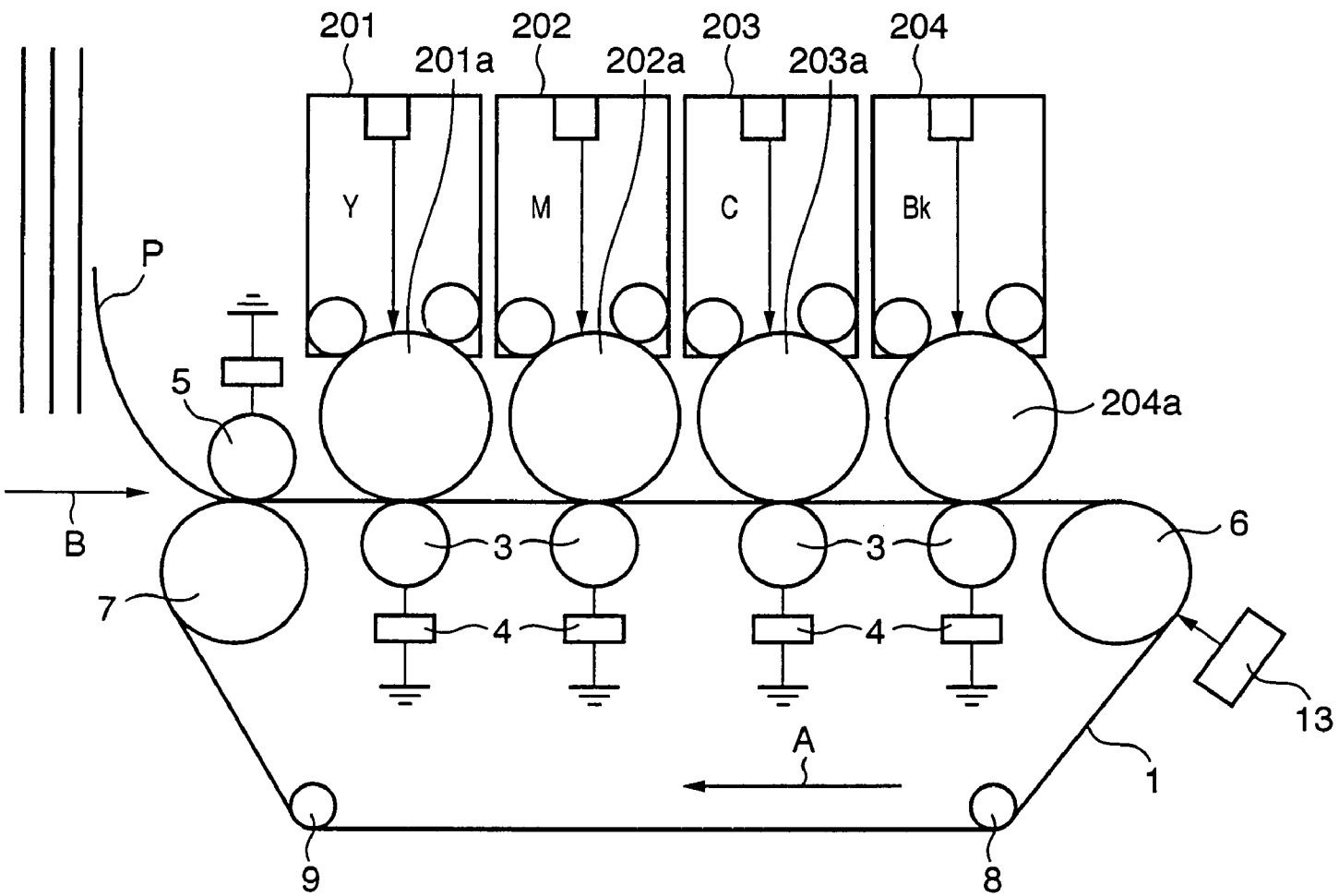
FIG. 1 depicts a view showing the schematic arrangement of the printing section of an image forming apparatus (laser beam printer) using an electrophotographic process according to an embodiment of the present invention.

FIG. 1 depicts a conceptual view for explaining the in-line arrangement of an electrophotographic image forming apparatus (laser beam printer) according to the first embodiment of the present invention.

In FIG. 1, an electrostatic chuck/convey belt (to be referred to as an ETB hereinafter) 1 is looped by a driving roller 6, a facing chuck roller 7, and tension rollers 8 and 9, and rotates in a direction indicated by an arrow A. A process station (yellow) 201, process station (magenta) 202, process station (cyan) 203, and process station (black) 204 for different colors are aligned in a line on the outer surface of the ETB 1, as shown in FIG. 1. Photosensitive drums 201*a* to 204*a* in the respective process stations abut against transfer rollers 3 via the ETB 1. A chuck roller 5 is arranged on the upstream side of the process stations, and abuts against the facing chuck roller 7 via the ETB 1. When a transfer medium (print sheet) P passes through a nip formed by the chuck roller 5 and facing chuck roller 7, a bias is applied to the transfer medium P. The transfer medium P is then electrostatically chucked by the ETB 1 and conveyed in a direction indicated by an arrow B.

Examples of the ETB 1 are a resin film of PVdF, ETFE, polyimide, PET, or polycarbonate with a thickness of 50 to 200 μm and a volume resistivity of 109 to 1,016 [Ωcm], and a belt prepared by forming an upper layer containing fluoroplastics such as PTFE dispersed in polyurethane rubber on a rubber base layer of EPDM or the like, with a thickness of about 0.5 to 2 mm.

An image forming process will be explained.

An image forming process in each process station will be first described. A process station for a yellow component will be exemplified, but the image forming process is similarly executed in stations for other colors.

Figure 2:
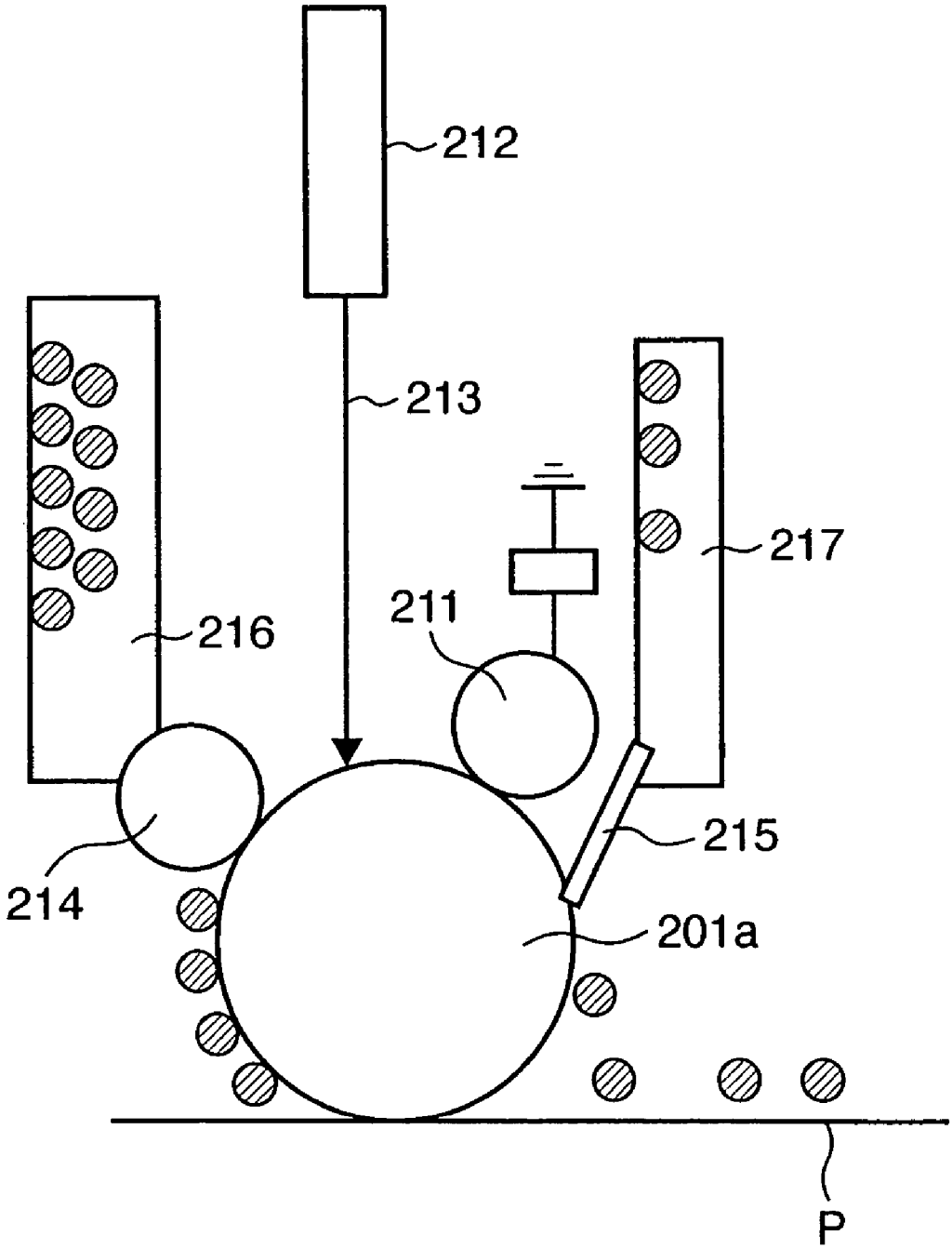
FIG. 2 depicts a view for explaining the arrangement of one image forming process according to the embodiment.

FIG. 2 is a block diagram for explaining the arrangement of the yellow process station 201. The same reference numerals as those in FIG. 1 denote the same parts.

The surface of the photosensitive drum 201*a* is uniformly charged by a charger 211, and an electrostatic latent image is formed by scanning light 213 from an exposure optical system 212. The electrostatic latent image is developed by supplying toner from a toner vessel 216 to the surface of the photosensitive drum 201*a* by a developing roller 214, and a toner image is formed on the photosensitive drum 201*a*. Reference numeral 215 denotes a cleaning blade which scrapes, from the surface of the photosensitive drum 201*a*, residual transfer toner that is not transferred in a transfer process (to be described later). The scraped toner is stored in a waste toner vessel 217.

A transfer process will be explained.

In a generally used reversal development method, when the photosensitive drum 201*a* is, e.g., a negative-polarity OPC photosensitive body, negative-polarity toner is used in developing an exposed portion (electrostatic latent image).

Hence, a positive-polarity transfer bias is applied from a bias power supply 4 to the transfer roller 3 in FIG. 1. The transfer roller 3 is generally a low-resistance roller.

In an actual print process, image formation, the transfer process, and conveyance of the transfer medium P are performed at timings at which the positions of toner images of respective colors to be formed on the transfer medium P coincide with each other in consideration of the moving speed of the ETB 1 and the distance between the transfer positions of the process stations. A full-color toner image is formed on the transfer medium P while the transfer medium P passes through the process stations 201 to 204. After the toner image is formed on the transfer medium P, the transfer medium P passes through a known fixing device to fix the toner image onto the transfer medium P.

Figure 3:
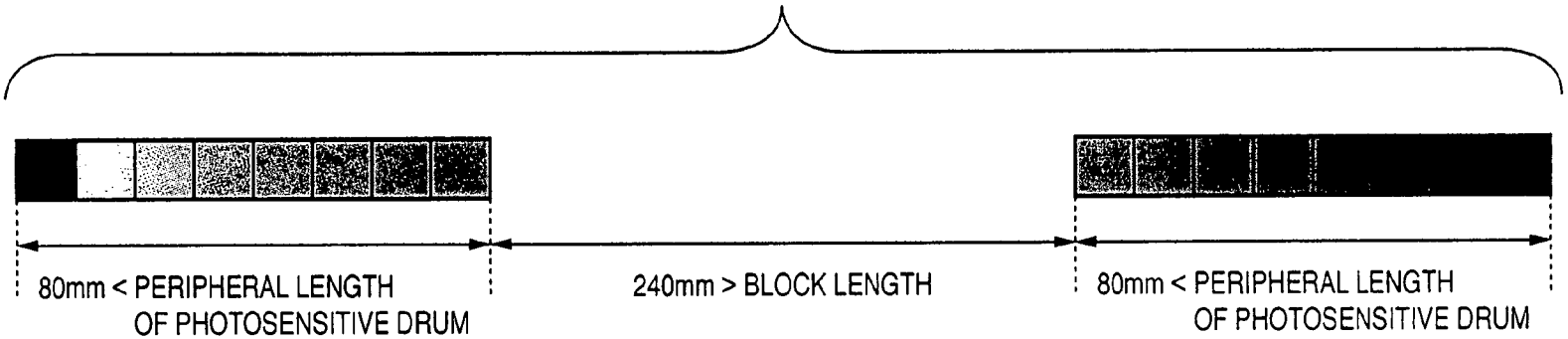
FIG. 3 depicts a view for explaining an example of forming a density patch according to the first embodiment of the present invention.

FIG. 3 depicts a view for explaining a feature according to the first embodiment of the present invention.

In the first embodiment, a PVdF resin film having a peripheral length of 800 mm and a thickness of 100 μm is adopted as the ETB 1. A density sensor 13 uses a sensor having an arrangement shown in FIG. 4. The density sensor 13 will be first explained.

Figure 4:
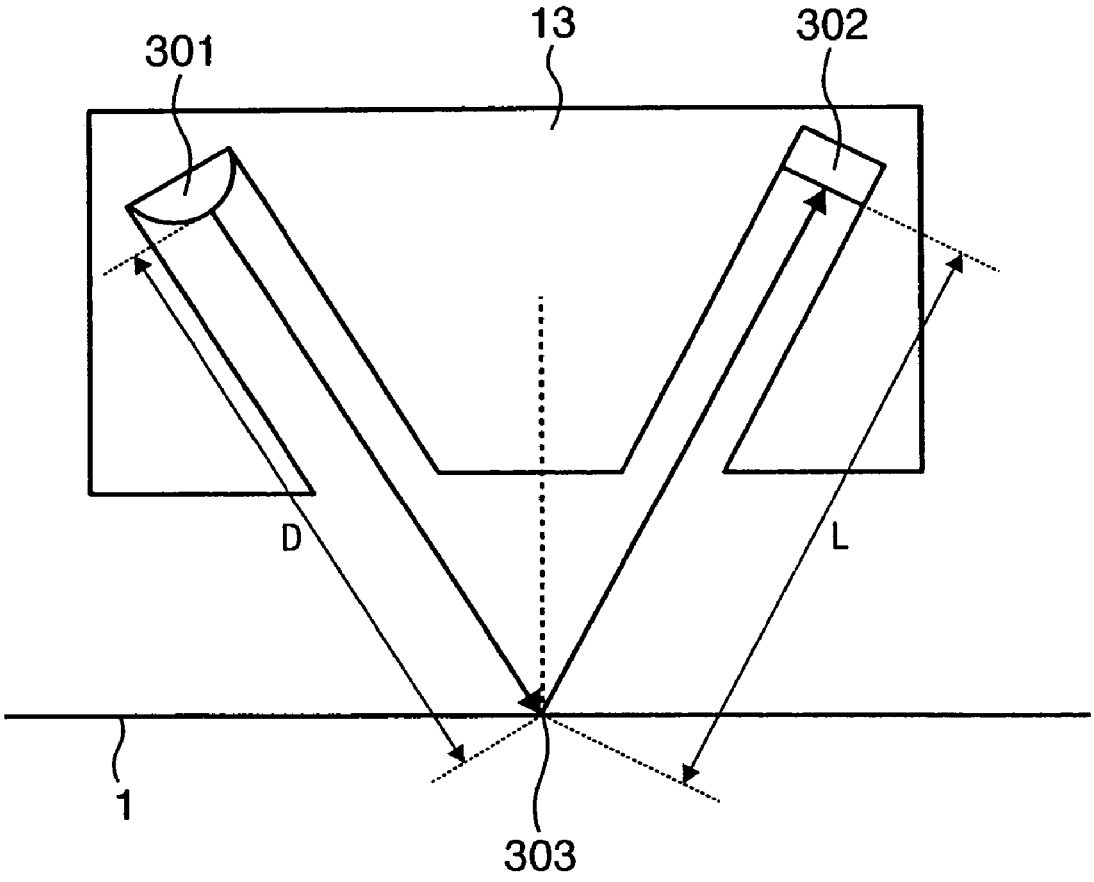
FIG. 4 depicts a view for explaining the arrangement of a density sensor according to the embodiment.

As shown in FIG. 4, the density sensor 13 comprises a light-emitting element 301 such as an LED, and a light-receiving element 302 such as a photodiode. Irradiation light emitted by the light-emitting element 301 is incident on the ETB 1 at an angle of about 30°, and reflected at a detection position (irradiation position) 303. The light-receiving element 302 is arranged at a position where light reflected at the same angle as that of irradiation light is detected. The density sensor 13 used in the first embodiment has a characteristic of increasing the output voltage for a higher reflected-light intensity.

The characteristic of reflected light detected in detecting the density of a density patch by using the density sensor 13 will be described in detail.

Figure 5:
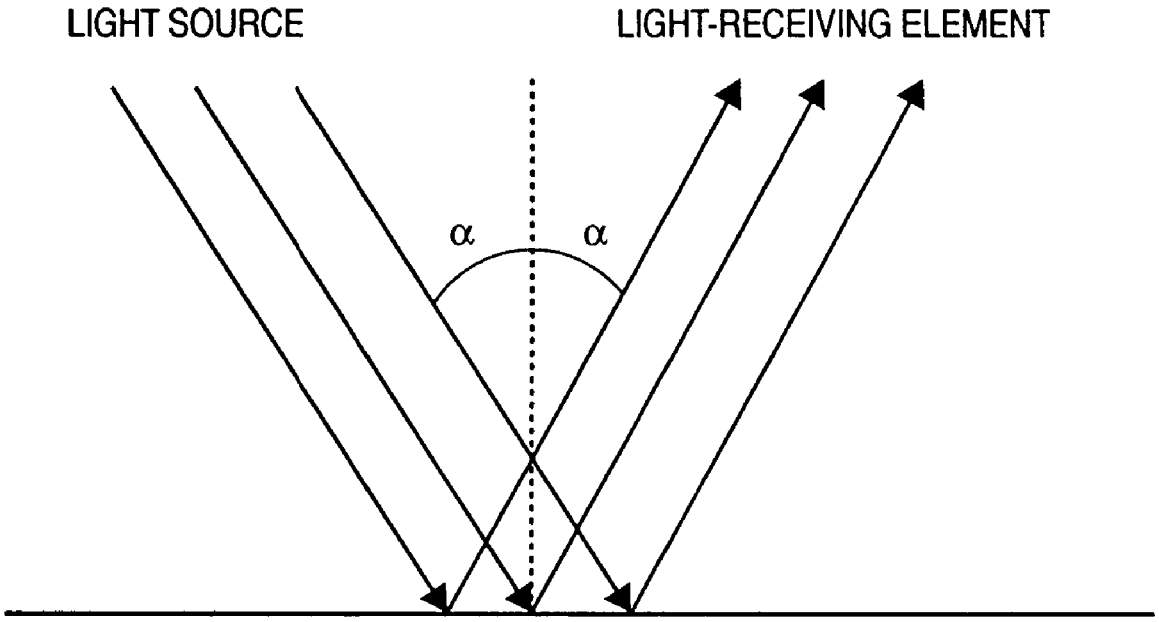
FIG. 5 depicts a view for explaining detection of light reflected by an ETB in the embodiment.

Light incident on the lower ETB 1 is reflected in accordance with a refractive index unique to the material of the ETB 1 and a refractive index determined by the surface state, as shown in FIG. 5. Reflected light is detected by the light-receiving element 302.

Figure 6:
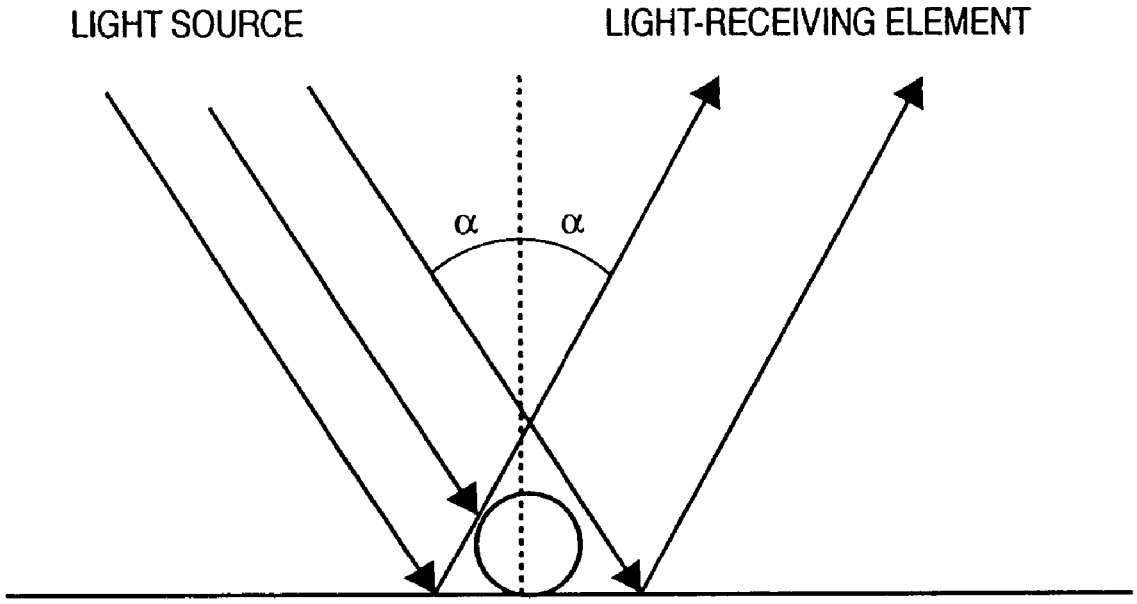
FIG. 6 depicts a view for explaining detection of reflected light when toner is formed on the ETB in the embodiment.

FIG. 6 depicts a view for explaining light reflection when a density patch is formed on the ETB 1. In this case, an underlayer below toner which forms the density patch is hidden, and the reflected-light quantity which reaches the light-receiving element 302 decreases.

Figure 7:
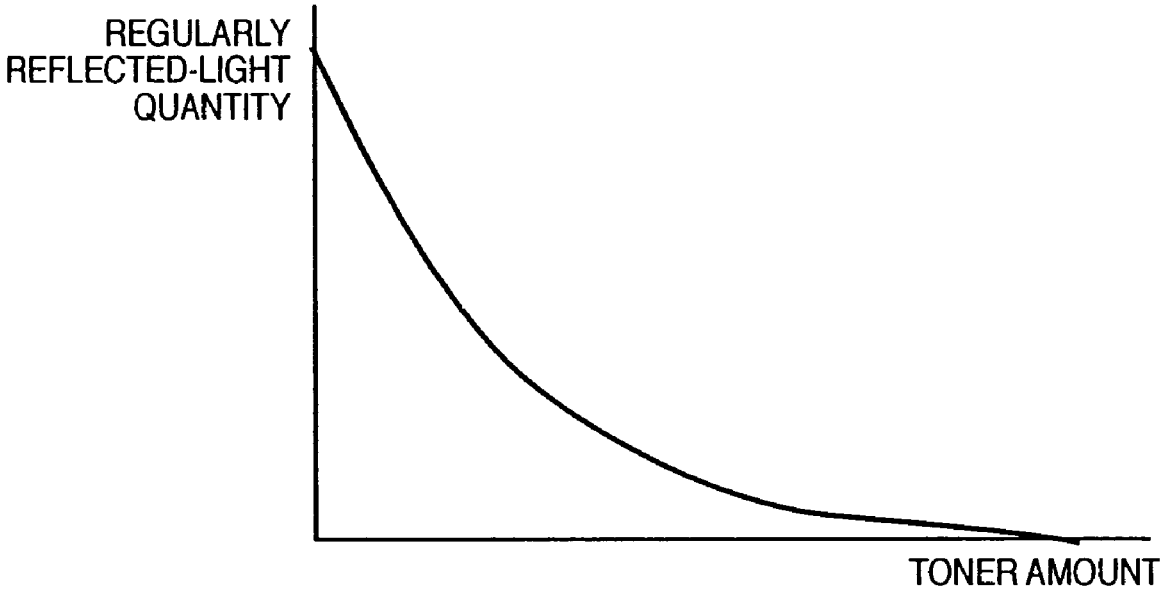
FIG. 7 depicts a graph for explaining the relationship between the toner amount and the reflected-light quantity.

FIG. 7 depicts a graph for explaining the relationship between the toner amount on the ETB 1 and the reflected-light quantity.

As shown in FIG. 7, as the toner amount of the density patch increases, the reflected-light quantity decreases. The density of the density patch is obtained on the basis of the decrease amount of reflected light. In practice, the surface state of the underlayer varies depending on the use frequency of the ETB 1. Along with this, the reflected-light quantity also varies in comparison with the ETB 1 in an initial state. Considering this, it is general to normalize the reflected-light quantity of the density patch by the reflected-light quantity of the underlayer and convert the reflected-light quantity of the density patch into density information.

A density patch forming method according to the first embodiment will be explained. The first embodiment will exemplify Dhalf control, and Dmax control is also similarly practiced to obtain the same effects.

In the first embodiment, a photosensitive drum having a peripheral length of 90 mm is employed, and the length of one density patch is set to 10 mm. The number of density patches is 16 for one color.

FIG. 3 depicts a view for explaining the layout of cyan density patches in the first embodiment. The remaining colors also have the same density patch layout as that of cyan. In the first embodiment, as shown in FIG. 3, 16 density patches (having 16 densities) are classified into two blocks (one block includes eight density patches). These density patches are formed on the ETB 1 at an interval of 240 mm between the blocks.

The block length of one block is 80 mm which is shorter than the 90-mm peripheral length of the photosensitive drum 203*a*. Hence, density patches are free from any influence (memory effect) of density patches formed in one turn of the photosensitive drum 203*a*.

A subsequent block is formed at an interval of 80 mm or more which is the length of each block. In forming density patches of the subsequent block, the density patches can be formed using a portion which is not used in the previous turn of the photosensitive drum 203*a*, and are not influenced by the memory effect on the photosensitive drum.

The purpose of the present invention can be satisfactorily achieved by setting the interval between blocks to be equal to or more than the block length (e.g., 80 mm). In the first embodiment, the interval between blocks is set to 240 mm, and magenta, yellow, and black density patches are formed between cyan blocks, shortening the time necessary for density control.

Figure 8:
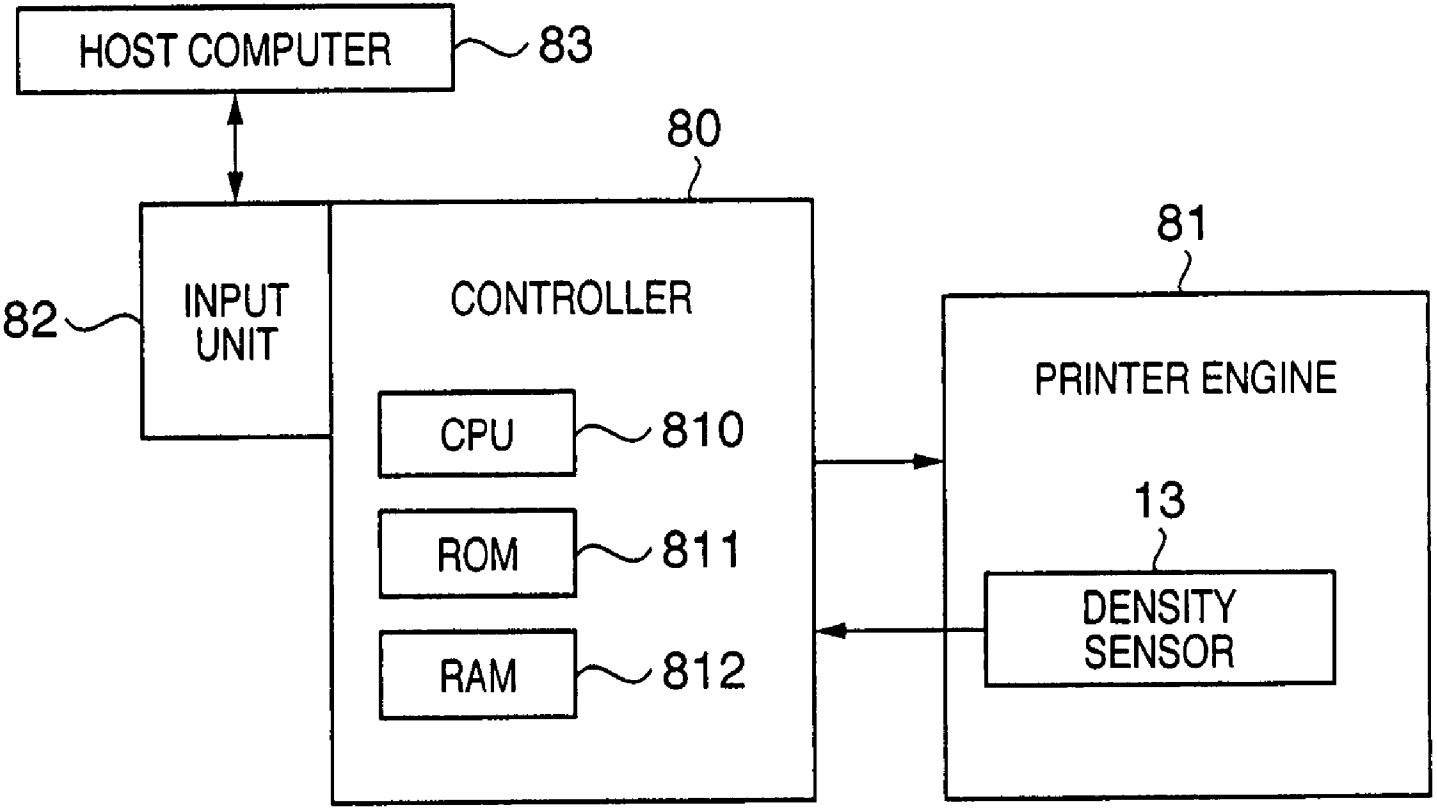
FIG. 8 is a functional block diagram for explaining the schematic functional arrangement of the image forming apparatus (laser beam printer) using the electrophotographic process according to the embodiment of the present invention.

FIG. 8 is a block diagram showing the schematic functional arrangement of the laser beam printer according to the first embodiment of the present invention.

In FIG. 8, reference numeral 80 denotes a controller which controls the operation of the laser beam printer according to the first embodiment. Reference numeral 81 denotes a printer engine which comprises, e.g., an arrangement as shown in FIG. 1 and forms an image under the control of the controller 80. Reference numeral 82 denotes an input unit which receives print data, a command, or the like sent from a host computer 83.

Reference numeral 810 denotes a CPU which controls the operation of the whole apparatus in accordance with a control program stored in a ROM 811. Reference numeral 812 denotes a RAM which is used as a work area for control operation by the CPU 810, and stores print data or the like transmitted from the host computer 83.

Figure 9:
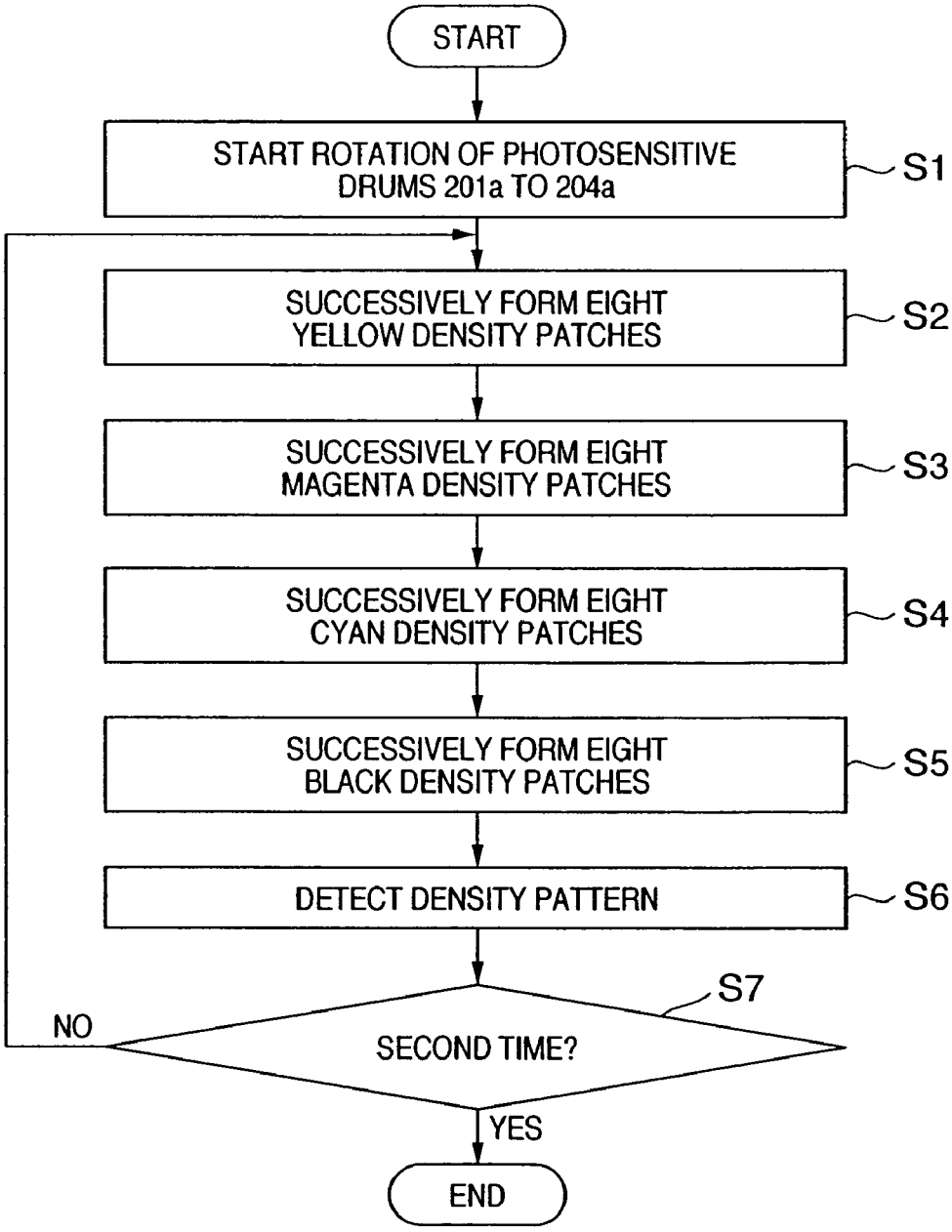
FIG. 9 is a flow chart for explaining density patch formation and density processing according to the first embodiment of the present invention.

FIG. 9 is a flow chart for explaining density patch formation and detection processing in the laser beam printer according to the first embodiment. A program for executing this processing is stored in the ROM 811, and executed under the control of the CPU 810.

In step S1, rotation of the photosensitive drums 201*a* to 204*a* starts. The flow advances to step S2 to successively form eight yellow density patches, as shown in FIG. 3. The flow advances to step S3 to similarly successively form eight magenta density patches. The flow advances to step S4 to similarly successively form eight cyan density patches. The flow advances to step S5 to similarly successively form eight black density patches. In step S6, the formed density patches are read by the density sensor 13 to obtain their density values. In step S7, whether 16 density patches have been formed for each color is determined. If NO in step S7, the flow returns to step S2 to execute the above processing; if YES, the processing ends.

As described above, according to the first embodiment, when the total length of density patches of one color exceeds the peripheral length of the photosensitive drum, the density patches are classified into a plurality of blocks. The length of one block is set within the peripheral length of the photosensitive drum, and the interval between blocks is set equal to or more than the block length. Even when the number of density patches is increased, an accurate density can be detected without any influence of the memory effect on the photosensitive drum surface.

[Second Embodiment]

The second embodiment of the present invention will be described.

Also in the second embodiment, a photosensitive drum having a peripheral length of 90 mm is employed, and the length of one density patch is set to 10 mm. The number of density patches is 16 for one color. The hardware arrangement of a laser beam printer according to the second embodiment is the same as that according to the first embodiment, and a description thereof will be omitted.

In the second embodiment, the size of one density patch is set to an almost odd fraction (1/9 in the second embodiment) of the peripheral length of the photosensitive drum. Density patches are scatteredly formed at an interval.

Figure 10:
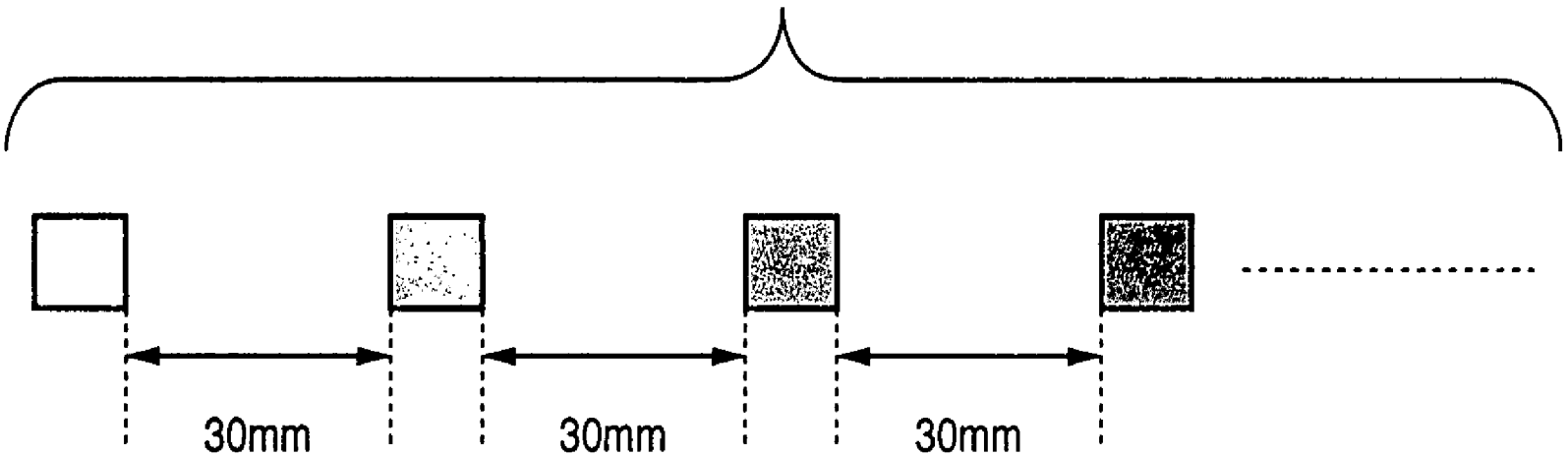
FIG. 10 depicts a view for explaining an example of forming a density patch according to the second embodiment of the present invention.

FIG. 10 depicts a view for explaining a method of forming cyan density patches in the second embodiment.

In the second embodiment, as shown in FIG. 10, density patches are formed at an interval of 30 mm. Alternatively, the purpose of the present invention can also be achieved by scatteredly forming 10-mm long density patches at an interval of, e.g., 10 mm. In the second embodiment, the interval between density patches is set to 30 mm (corresponding to three density patches). Density patches of the remaining color components, i.e., magenta, yellow, and black are formed during a time corresponding to the interval, shortening the time necessary for density control.

The reason why the second embodiment sets the size of one density patch to an odd fraction of the peripheral length of the photosensitive drum will be explained.

FIG. 11 depicts a table showing the order of using the photosensitive drum surface when the photosensitive drum surface is segmented into nine (A to I) and density patches are formed every fourth interval.

As is apparent from FIG. 11, a location where a density patch is formed is a portion at which no density patch is formed in a previous turn. The density patch is not influenced by the memory effect on the photosensitive drum.

The size of one density patch can also be set to an even fraction of the peripheral length of the photosensitive drum so as not to influence the density patch by the memory effect on the photosensitive drum, as described above. In this case, however, the interval between density patches must be set to an even number of density patches.

A general color laser beam printer uses four colors: cyan, magenta, yellow, and black. In order to shorten the time necessary for density control, it is desirable to form density patches of three colors between density patches of one color, i.e., set the interval between density patches to three density patches, as shown in FIGS. 10 and 11. It is, therefore, undesirable to set the size of one density patch to an even fraction of the peripheral length of the photosensitive drum.

Figure 12:
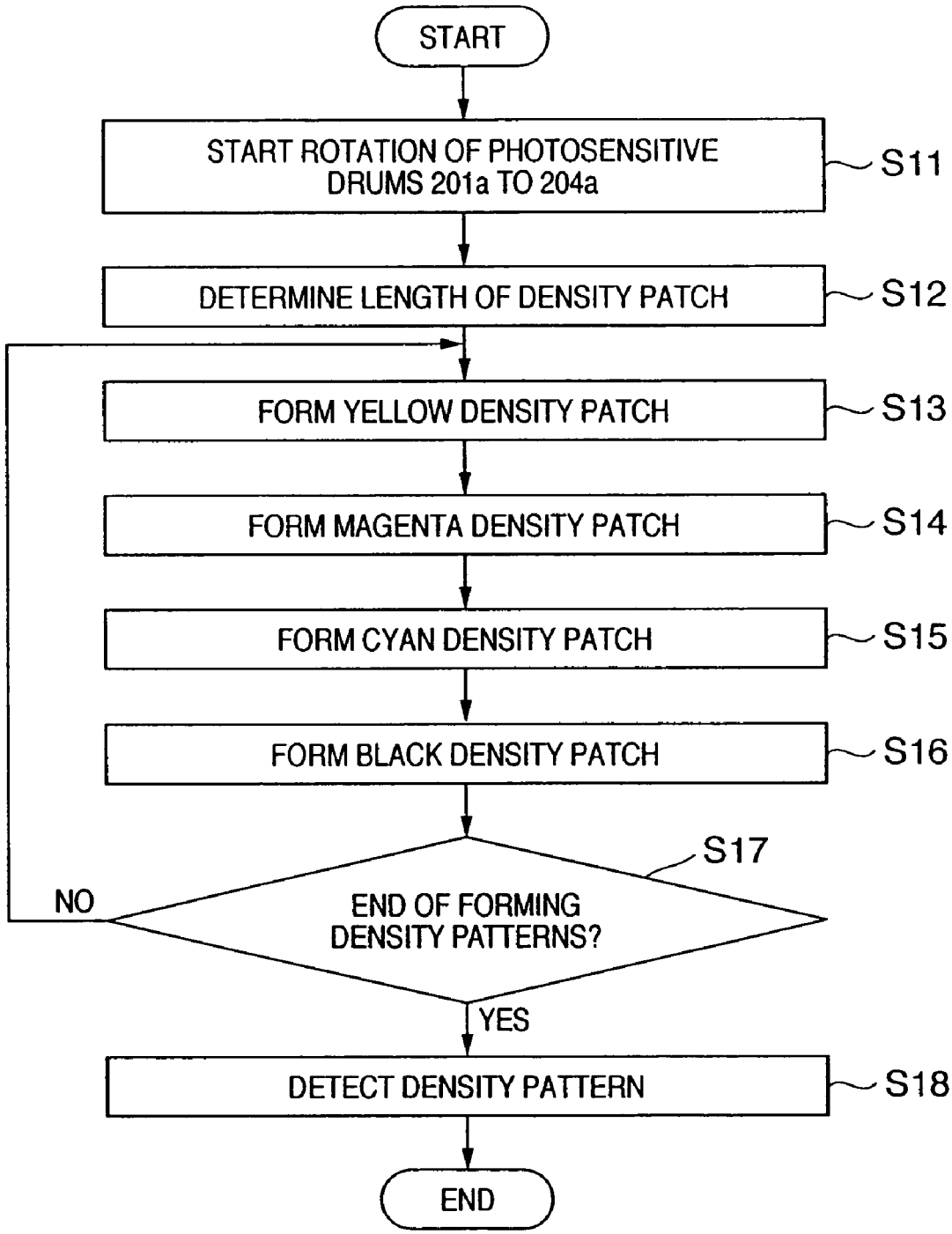
FIG. 12 is a flow chart for explaining density patch formation and density processing according to the second embodiment of the present invention.
Figure 13:
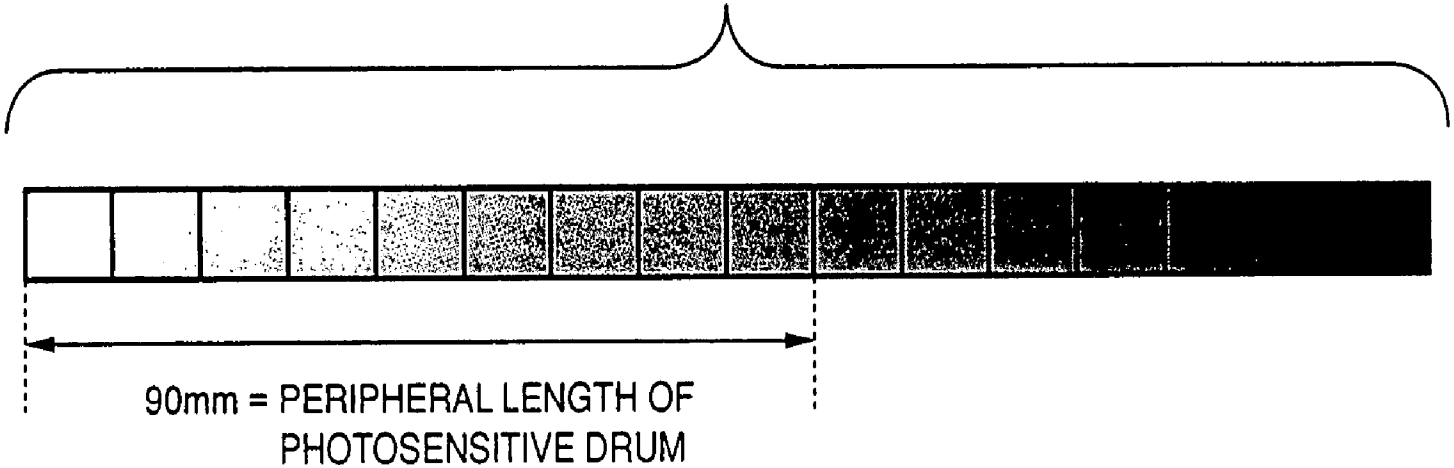
FIG. 13 depicts a view for explaining, as a conventional problem, an example of a density patch which is influenced by the memory effect on a photosensitive drum.

FIG. 12 is a flow chart for explaining density patch formation and density processing according to the second embodiment of the present invention. A program for executing this processing is stored in a ROM 811.

In step S11, rotation of the photosensitive drums 201*a* to 204*a* starts. The flow advances to step S12 to determine the length of each density patch on the basis of the peripheral length of the photosensitive drum. In the second embodiment, the peripheral length of each photosensitive drum is 90 mm, and the length of each density patch is set to 1/9, i.e., 10 mm.

The flow advances to step S13 to form one yellow density patch. The flow advances to step S14 to form one magenta density patch. The flow advances to step S15 to form one cyan density patch. The flow advances to step S16 to form one black density patch. In step S17, whether density patches of the respective colors have been formed is determined. If NO in step S17, the flow returns to step S13 to execute the above processing; if YES, density patches scattered at an interval as shown in FIG. 10 are formed. The flow advances to step S18 to read the formed density patches by a density sensor 13 and obtain their density values.

As described above, according to the second embodiment, the size (width) of one density patch is set to an odd fraction ($\neq 1$) of the peripheral length of the photosensitive drum, and a plurality of density patches are scatteredly formed on the photosensitive drum. An accurate density can be detected without any influence of the memory effect on the photosensitive drum.

[Other Embodiment]

As described above, the object of the present invention is also achieved when a storage medium which stores software program codes for realizing the functions of the above-described embodiments is provided to a system or apparatus, and the computer (or the CPU or MPU) of the system or apparatus reads out and executes the program codes stored in the storage medium. In this case, the program codes read out from the storage medium realize the functions of the above-described embodiments, and the storage medium which stores the program codes constitutes the present invention. The storage medium for supplying the program codes includes a floppy® disk, hard disk, optical disk, magnetooptical disk, CD-ROM, CD-R, magnetic tape, non-volatile memory card, and ROM.

The functions of the above-described embodiments are realized when the computer executes the readout program codes. Also, the functions of the above-described embodiments are realized when an OS (Operating System) or the like running on the computer performs part or all of actual processing on the basis of the instructions of the program codes.

Furthermore, the present invention also includes a case in which, after the program codes read out from the storage medium are written in the memory of a function expansion board inserted into the computer or the memory of a function expansion unit connected to the computer, the CPU of the function expansion board or function expansion unit performs part or all of actual processing on the basis of the instructions of the program codes and thereby realizes the functions of the above-described embodiments.

As has been described above, according to the embodiments, when the total length of density patches of one color exceeds the length of one turn of the photosensitive drum, the density patches are classified into a plurality of blocks. The length of one block is set within the peripheral length of the photosensitive drum, the interval between blocks is set equal to or more than the block length, and density patches are formed. Even when the number of density patches is increased, density patches can be formed using a portion which is not used in the previous turn of the photosensitive drum. An accurate density can be detected without any influence of the memory effect on the photosensitive drum.

The same effects can also be obtained when the size (width) of one density patch is set to an odd fraction (≠1) of the peripheral length of the photosensitive drum, and density patches are scatteredly formed on the photosensitive drum. As a result, an accurate density can be detected.

The present invention is not limited to the above embodiments and various changes and modifications can be made within the spirit and scope of the present invention. Therefore, to apprise the public of the scope of the present invention, the following claims are made.

What is claimed is:

1. An image forming apparatus comprising:

a photosensitive member;

a charging unit configured to electrically charge a surface of said photosensitive member;

an exposing unit configured to form an electrostatic latent image by exposing a charged surface of said photosensitive member;

a developing unit configured to form a visible image by developing the electrostatic latent image; and a pattern generator configured to generate a plurality of blocks of density patterns of monocolor for density detection during a plurality of turns of said photosensitive member, such that a given block is not formed in the same position on said photosensitive member in two successive turns of said photosensitive member.

2. The apparatus according to claim 1, wherein each of the plurality of blocks has a length smaller than the peripheral length of said photosensitive member, and said pattern generator generates density patterns such that each one of the blocks is formed at a predetermined interval larger than the length of that one block.

3. The apparatus according to claim 1, wherein each of the plurality of blocks is, in length, a substantially odd fraction (not including 1) of the peripheral length of said photosensitive member, and each block is formed at an interval at least three times larger than the length of that block.

4. The apparatus according to claim 1, further comprising a transfer rotary body that abuts against said photosensitive member, and wherein the density pattern is transferred from said photosensitive member to said transfer rotary body.

5. The apparatus according to claim 4, wherein said apparatus further comprising a density detector configured to detect density patterns on the transfer rotary body.

6. The apparatus according to claim 1, wherein each of the blocks has a plurality of steps of density level.

7. The apparatus according to claim 1, wherein each of the blocks has one step of density level.

8. A density pattern forming method in an image forming apparatus which comprises a photosensitive member; a charging unit that electrically charges a surface of the photosensitive member, a exposing unit that forms an electrostatic latent image by exposing a charged surface of the photosensitive member, and a developing unit that forms a visible image by developing the electrostatic latent image, said method comprising the steps of:

generating a plurality of blocks of density patterns of monocolor for density detection during a plurality of turns of the photosensitive member, such that a given block is not formed in the same position on the photosensitive member in two successive turns of the photosensitive member; and detecting, using a density detector, density patterns formed in said generating step.

* * * * *

UNITED STATES PATENT AND TRADEMARK OFFICE

CERTIFICATE OF CORRECTION

PATENT NO. : 7,027,748 B2
APPLICATION NO. : 10/778096
DATED : April 11, 2006
INVENTOR(S) : Kazuhiro Funatani It is certified that error appears in the above-identified patent and that said Letters Patent is hereby corrected as shown below:

COLUMN 3

Line 1, “with” should be deleted.
Line 12, “with” should be deleted.

COLUMN 10

Line 9, “comprising” should read --comprises--.
Line 19, “a” should read --an--.

Signed and Sealed this

Twenty-third Day of January, 2007

JON W. DUDAS
*Director of the United States Patent and Trademark Office*